US011530884B2

(12) United States Patent
Suzuki et al.

(10) Patent No.: US 11,530,884 B2
(45) Date of Patent: Dec. 20, 2022

(54) HEAT EXCHANGER

(71) Applicant: DENSO CORPORATION, Kariya (JP)

(72) Inventors: Kazutaka Suzuki, Kariya (JP); Taichi Asano, Kariya (JP)

(73) Assignee: DENSO CORPORATION, Kariya (JP)

( * ) Notice: Subject to any disclaimer, the term of this patent is extended or adjusted under 35 U.S.C. 154(b) by 36 days.

(21) Appl. No.: 17/071,261

(22) Filed: Oct. 15, 2020

(65) Prior Publication Data

US 2021/0025661 A1 Jan. 28, 2021

Related U.S. Application Data

(63) Continuation of application No. PCT/JP2019/011949, filed on Mar. 21, 2019.

(30) Foreign Application Priority Data

Apr. 19, 2018 (JP) ..... JP2018-080447

(51) Int. Cl.
*F28F 9/02* (2006.01)
*F28F 3/08* (2006.01)

(52) U.S. Cl.
CPC ..... *F28F 9/0226* (2013.01); *F28F 3/08* (2013.01); *F28F 2275/04* (2013.01); *F28F 2275/122* (2013.01)

(58) Field of Classification Search
CPC ..... F28F 9/0226; F28F 3/08; F28F 2275/04; F28F 2275/122; F28D 7/1661
USPC ..... 165/158
See application file for complete search history.

(56) References Cited

U.S. PATENT DOCUMENTS

| | | | | |
|---|---|---|---|---|
| 9,599,412 | B2 * | 3/2017 | Garret | F28F 9/0226 |
| 2013/0146267 | A1 * | 6/2013 | Garret | F28D 7/1653 165/175 |
| 2017/0016684 | A1 * | 1/2017 | Okubo | F28F 1/045 |
| 2017/0115069 | A1 * | 4/2017 | Ferrand | F02M 35/10268 |
| 2018/0023898 | A1 | 1/2018 | Saitou et al. | |
| 2020/0332706 | A1 * | 10/2020 | Kato | F28F 3/025 |

FOREIGN PATENT DOCUMENTS

| | | | | |
|---|---|---|---|---|
| FR | 2984478 | A1 * | 6/2013 | F02B 29/0462 |
| JP | 2008275244 | A | 11/2008 | |
| JP | 2013514514 | A | 4/2013 | |
| JP | 2014055711 | A | 3/2014 | |
| JP | 2017211101 | A | 11/2017 | |
| WO | WO-2016140203 | A1 | 9/2016 | |

* cited by examiner

*Primary Examiner* — Tho V Duong
(74) *Attorney, Agent, or Firm* — Harness, Dickey & Pierce, P.L.C.

(57) ABSTRACT

A heat exchanger includes a duct, a core portion, and a caulking plate. The duct has an inlet and an outlet. The core portion is housed in the duct in a state where cooling plates and cooling fins are stacked in a stacking direction. The caulking plate has a frame shape corresponding to an opening shape of the inlet and the outlet and brazed to the inlet and the outlet. The caulking plate is interposed between the duct and a tank to fix the tank. A first joint between the duct and the core portion and a second joint between the duct and the caulking plate are distanced from each other in the stacking direction by a predetermined distance. The duct has a rib between the first joint and the second joint or at the second joint.

11 Claims, 8 Drawing Sheets

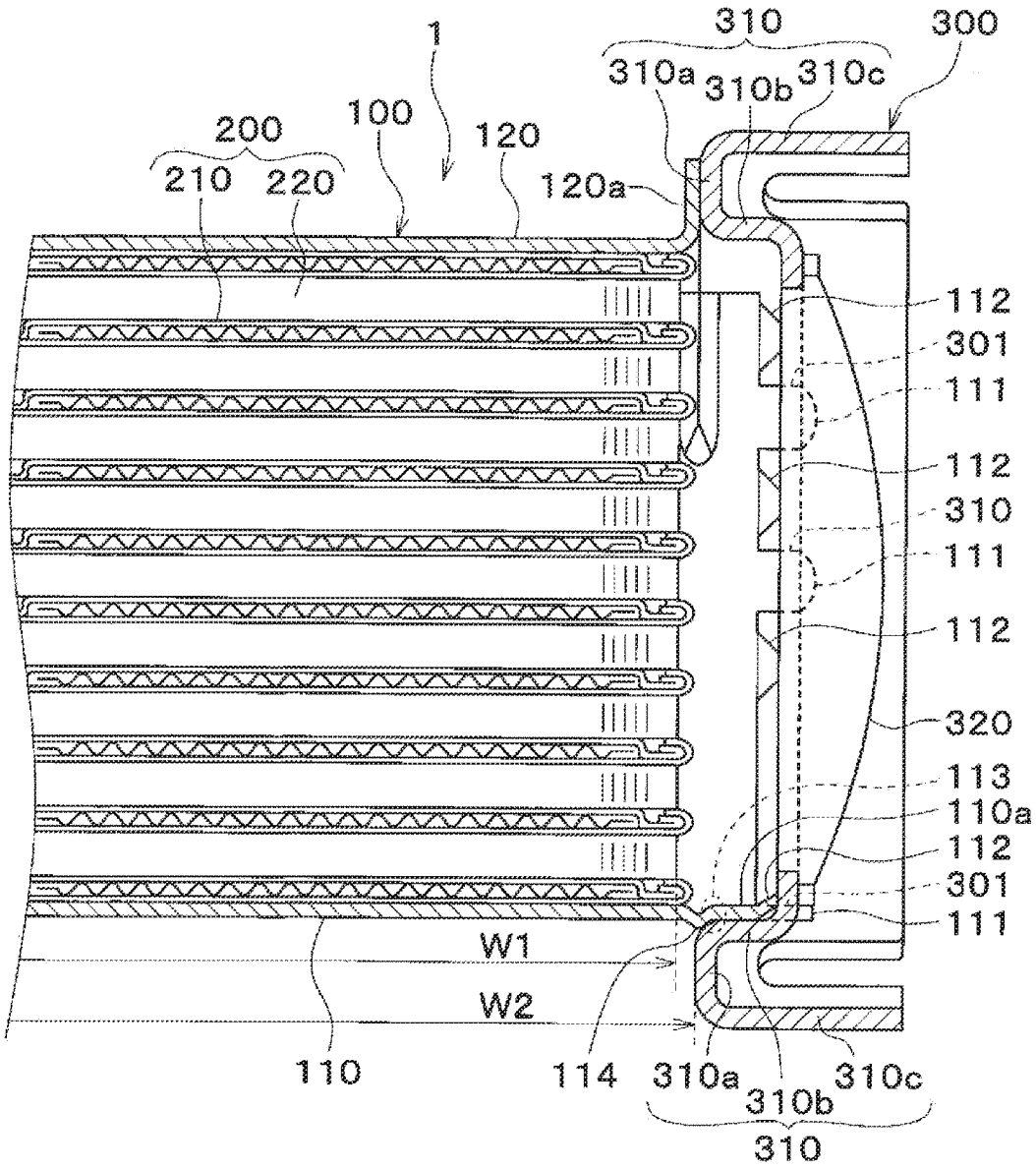
FIG. 5
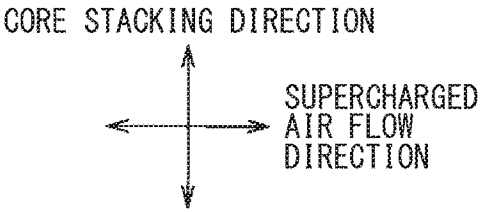

HEAT EXCHANGER

CROSS REFERENCE TO RELATED APPLICATION

The present application is a continuation application of International Patent Application No. PCT/JP2019/011949 filed on Mar. 21, 2019, which designated the U.S. and claims the benefit of priority from Japanese Patent Application No. 2018-80447 filed on Apr. 19, 2018. The entire disclosures of all of the above applications are incorporated herein by reference.

TECHNICAL FIELD

The present disclosure relates to a heat exchanger.

BACKGROUND

A heat exchanger includes a core portion for exchanging heat between cooling fluid and supercharged air, a duct housing the core portion, and a caulking plate provided on the duct to fix a tank.

SUMMARY

According to an aspect of the present disclosure, a heat exchanger includes:

a duct having an inlet to introduce a first fluid and an outlet to discharge the first fluid;

a core portion in which heat is exchanged between the first fluid and a second, the core portion having a plurality of cooling plates and a plurality of cooling fins alternately stacked with each other in a stacking direction and housed in the duct, a flow path being defined for the second fluid by the cooling plates; and a caulking plate having a frame shape corresponding to an opening shape of the inlet and the outlet and brazed to the inlet and the outlet, the caulking plate being interposed between the duct and a tank to fix the tank.

A first joint between the duct and the core portion and a second joint between the duct and the caulking plate are distanced from each other in the stacking direction by a predetermined distance, and the duct has a rib between the first joint and the second joint or at the second joint.

BRIEF DESCRIPTION OF THE DRAWINGS

FIG. 5 is a cross-sectional view taken along a line V-V of FIG. 1, in which a tank omitted.

DETAILED DESCRIPTION

Figure 1:
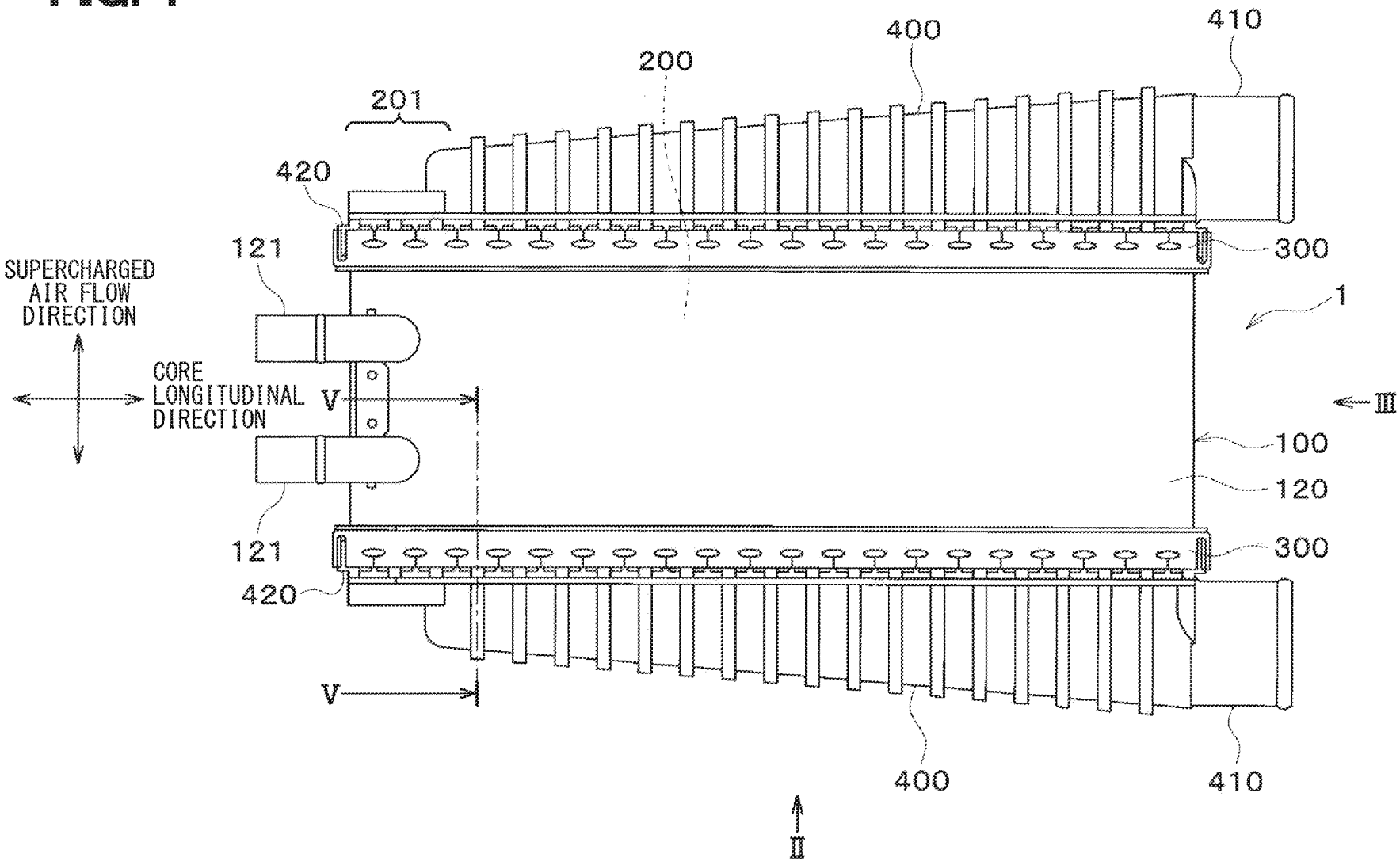
FIG. 1 is a plan view of a heat exchanger according to a first embodiment.

To begin with, examples of relevant techniques will be described.

A heat exchanger includes: a core portion for exchanging heat between a cooling fluid and supercharged air; a duct for housing the core portion and through which the supercharged air flows; a caulking plate provided at an air inflow/outflow part of the duct; and a tank fixed to the caulking plate and connected to an internal combustion engine. In the core portion, cooling plates and radiation fins are alternately stacked with each other. The core portion is interposed and compressed between two duct plates, and the caulking plate is mounted to the core portion to be integrally brazed.

However, when the stacking number of the cooling plates and the radiation fins is large, interference is likely to occur between the core portion and the caulking plate. If the core portion is over-compressed in order to avoid the interference between the core portion and the caulking plate, the radiation fin will buckle and the pressure withstanding property will be lowered.

These issues can be solved by extending a width of the duct to which the caulking plate is attached. However, a fragile part is generated in the extended part of the duct when the width of the duct is increased. If excessive stress is generated in the brazed part near the fragile part, the pressure withstanding property of the heat exchanger is lowered.

The present disclosure provides a heat exchanger in which a caulking plate is mounted on a duct housing a core portion while suppressing a decrease in the pressure withstanding property of the heat exchanger.

According to an aspect of the present disclosure, a heat exchanger includes a duct, a core portion and a caulking plate. The duct has an inlet to introduce a first fluid and an outlet to discharge the first fluid. In the core portion, heat is exchanged between the first fluid and a second fluid. The core portion has cooling plates and cooling fins alternately stacked with each other in a stacking direction and housed in the duct. A flow path is defined for the second fluid by the cooling plates. The caulking plate has a frame shape corresponding to an opening shape of the inlet and the outlet and brazed to the inlet and the outlet, and is interposed between the duct and a tank to fix the tank.

A first joint between the duct and the core portion and a second joint between the duct and the caulking plate are distanced from each other in the stacking direction by a predetermined distance, and the duct has a rib between the first joint and the second joint or at the second joint.

Accordingly, when the duct is deformed by high-pressure supercharged air, if the rib is a buffer rib, the stress concentrated on the second joint between the duct and the caulking plate can be relieved. If the rib is a reinforcing rib, the deformation of the duct can be suppressed. Thereby, the pressure withstanding property of the heat exchanger can be improved.

Hereinafter, embodiments for implementing the present disclosure will be described referring to drawings. In the respective embodiments, parts corresponding to matters already described in the preceding embodiments are given reference numbers identical to reference numbers of the matters already described. The same description is therefore omitted depending on circumstances. In the case where only a part of the configuration is described in each embodiment, the other embodiments described above can be applied to the other part of the configuration. The present disclosure is not limited to combinations of embodiments which combine parts that are explicitly described as being combinable. The various embodiments may be partially combined with each other even if not explicitly described.

First Embodiment

Hereinafter, a first embodiment of the present disclosure will be described with reference to the drawings. A heat exchanger according to the present embodiment is used as a water-cool intercooler that causes high-temperature supercharged air pressurized by a supercharger and cooling water to exchange heat with each other to thereby cool the intake air.

As shown in FIGS. 1 to 4, the heat exchanger 1 includes a duct 100, a core portion 200, a caulking plate 300, and a tank 400.

Figure 3:
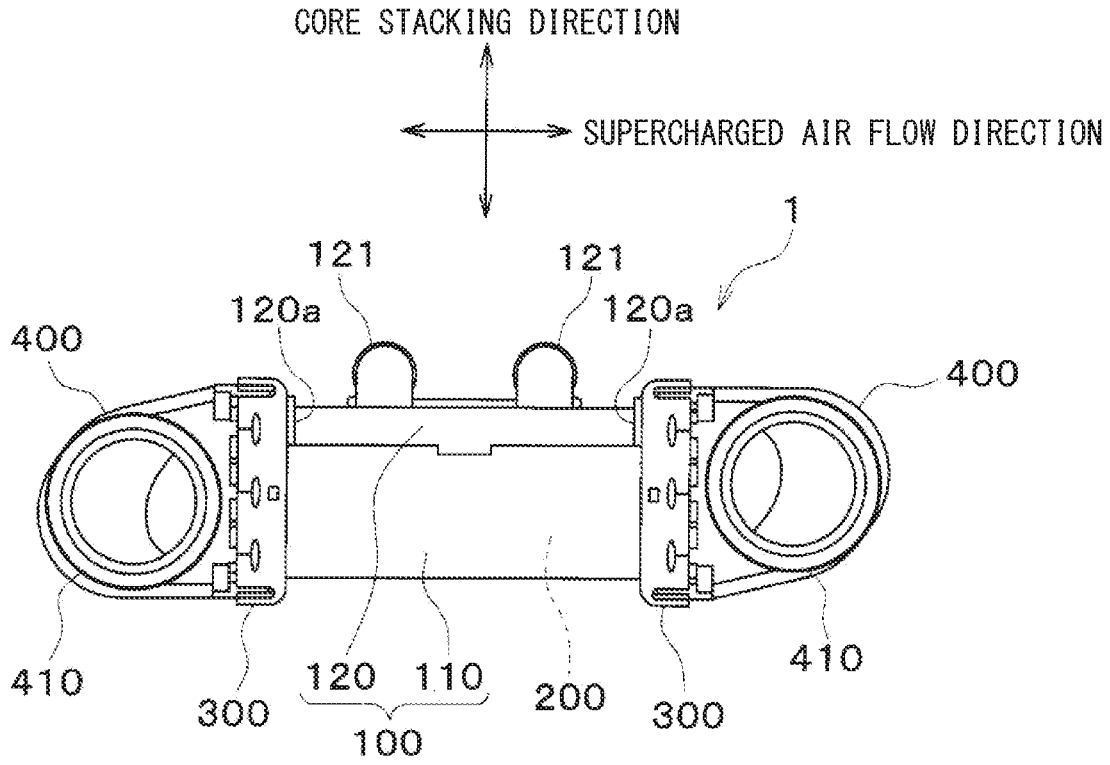
FIG. 3 is a view seen in an arrow direction III of FIG. 1.
Figure 4:
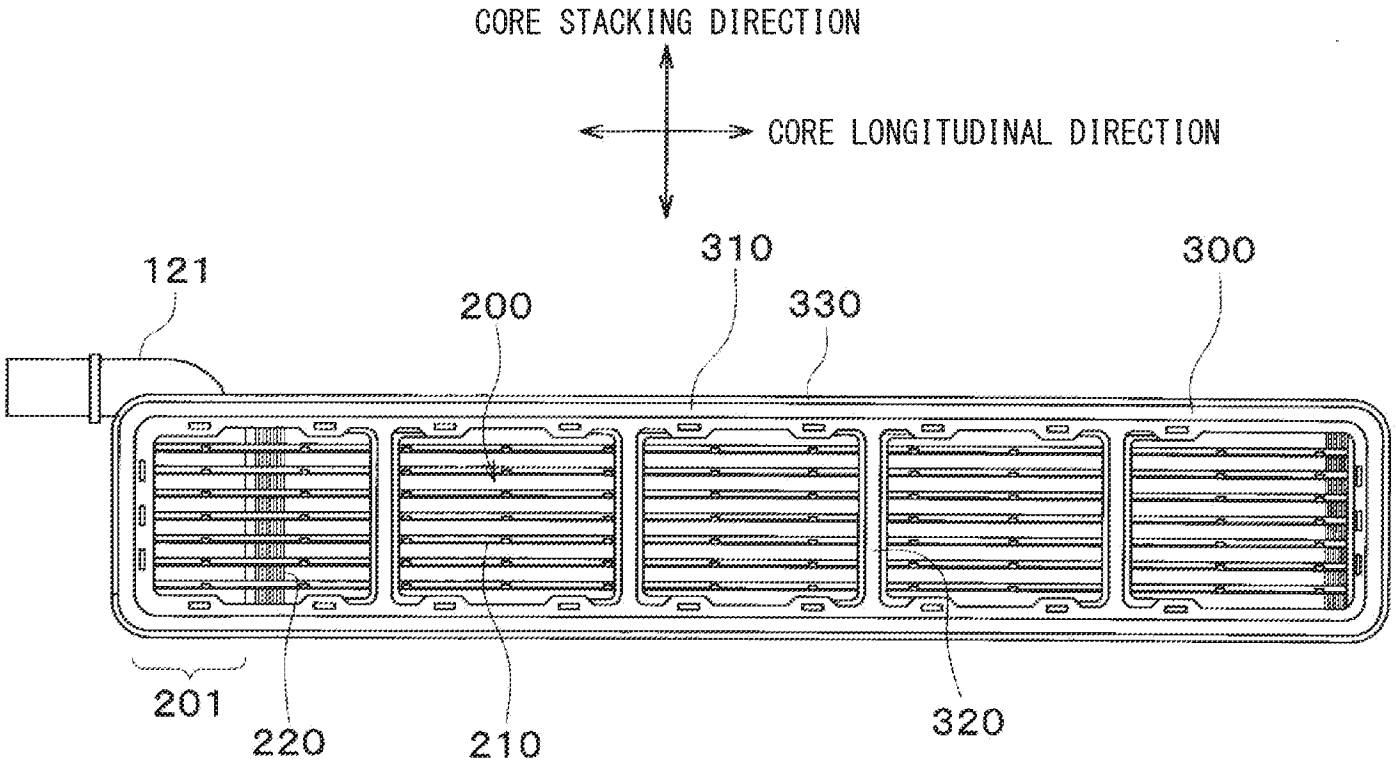
FIG. 4 is a view seen in the arrow direction II of FIG. 1, in which a tank is omitted.

The duct 100 is a tubular component through which supercharged air flows. The tubular duct 100 has openings at both ends, and the supercharged air flows in a direction connecting the two openings, which is referred to a supercharging air flow direction. Of the two openings of the duct 100, one opening serves as an inlet for introducing the supercharged air into the inside, and the other opening serves as an outlet for discharging the supercharged air from the inside. As shown in FIG. 4, the inlet and the outlet of the duct 100 are formed in a substantially rectangular shape. In FIG. 1, the inlet of the duct 100 is located on the lower side, and the outlet of the duct 100 is located on the upper side. In FIG. 3, the inlet of the duct 100 is located on the left side, and the outlet of the duct 100 is located on the right side. The supercharged air flows into the duct 100 from the inlet of the duct 100, and flows through the intake passage inside the duct 100. Then, the supercharged air flows out from the outlet of the duct 100. The positional relationship between the inlet and the outlet of the duct 100 may be reversed from each other.

As shown in FIG. 3, the duct 100 has two duct plates, e.g., the first duct plate 110 and the second duct plate 120. The first duct plate 110 is a lower duct plate arranged on the lower side, and the second duct plate 120 is an upper duct plate arranged on the upper side. The duct plate 110, 120 is a plate-shaped member having a U-shaped cross section. The first duct plate 110 and the second duct plate 120 are assembled in a tubular shape that houses the core portion 200. The duct plate 110, 120 is formed by pressing a thin plate made of metal such as aluminum.

A cooling water pipe 121 is provided on the second duct plate 120. A cooling water piping (not shown) through which cooling water flows is connected to the cooling water pipe 121. The heat exchanger 1 is connected to a heat exchanger (not shown) that cools the cooling water via the cooling water piping.

The core portion 200 is a heat exchange unit that exchanges heat between the cooling water and the supercharged air. The core portion 200 is housed in the duct 100. The core portion 200 is formed of a metal member such as aluminum. The supercharged air corresponds to a first fluid of the present disclosure, and the cooling water corresponds to a second fluid of the present disclosure.

The core portion 200 has an inflow/outflow portion 201 through which cooling water flows in/out from the cooling water pipe 121. The inflow/outflow portion 201 is formed within a certain range of the core portion 200 adjacent to the cooling water pipe 121.

As shown in FIGS. 4 and 5, the core portion 200 has plural cooling plates 210 and plural cooling fins 220. The cooling plates 210 and the cooling fins 220 are alternately stacked with each other in a stacking direction.

The left-right direction of FIG. 4 corresponds to the longitudinal direction of the core portion 200, and the up-down direction of FIG. 4 corresponds to the stacking direction in the core portion 200. The supercharged air flow in a supercharged air flow direction perpendicular to the longitudinal direction of the core portion 200 and the stacking direction in the core portion 200. The left-right direction of FIG. 5 corresponds to the supercharged air flow direction. The up-down direction of FIG. 5 is the stacking direction in the core portion 200, and the longitudinal direction of the core portion 200 is perpendicular to the supercharged air flow direction and the stacking direction. Hereinafter, the longitudinal direction of the core portion 200 will be referred to as the core longitudinal direction. The stacking direction in the core portion 200 will be referred to as the core stacking direction. The core longitudinal direction is orthogonal to the core stacking direction and the supercharged air flow direction.

The internal space of the cooling plate 210 defines a flow path for the cooling water. An inner fin is arranged in the internal space of the cooling plate 210 to increase a heat transfer area, thereby promoting the heat exchange. The cooling plate 210 can be configured, for example, by bending one plate member. The cooling plates 210 are stacked with a constant interval relative to each other.

The cooling fin 220 is an outer fin, and the cooling plate 210 is interposed between the cooling fins 220. FIG. 4 illustrates a part of the cooling fin 220 in the core longitudinal direction, and the illustration of the remaining part of the cooling fin 220 is omitted.

The cooling fin 220 is arranged between the adjacent cooling plates 210 to cool the supercharged air. The cooling fin 220 is provided in a passage for the supercharged air inside the duct 100. The passage for the supercharged air is set within a range of the core portion 200 excluding the inflow/outflow portion 201.

The cooling water flows in or out of the inflow/outflow portion 201 through the cooling water pipe 121, in the core portion 200. The cooling water is dispersed to or collected from the cooling plates 210 via the inflow/outflow portion 201. The supercharged air passes between the cooling plates 210. Thereby, in the core portion 200, heat is exchanged between the supercharged air and the cooling water.

The caulking plate 300 is provided at each of the inlet and the outlet of the duct 100. The caulking plate 300 fixes the duct 100 while maintaining the duct 100 in the tube shape, and is an intermediate part between the duct 100 and the tank 400 to fix the tank 400. The caulking plate 300 is formed by pressing a thin metal plate made of aluminum or the like.

As shown in FIG. 4, the caulking plate 300 is formed in a substantially rectangular frame shape corresponding to an opening shape of the inlet and the outlet of the duct 100. The caulking plate 300 has a groove portion 310 and a beam 320.

The groove portion 310 is recessed toward the duct 100 along the inlet and the outlet of the duct 100, and houses the opening portion 420 of the tank 400. The outer surface of the groove portion 310 is joined to the duct 100. As shown in FIG. 5, the groove portion 310 has a bottom surface 310*a*, an inner wall surface 310*b*, and an outer wall surface 310*c*.

The beam 320 connects two different portions of the caulking plate 300. The beam 320 connects one long side and the other long side of the caulking plate 300. In the present embodiment, the caulking plate 300 has four beams 320. The beam 320 restricts distortion and deformation of the caulking plate 300 after the caulking plate 300 is formed by pressing, and restricts deformation of the core portion 200 when fix the tank 400 by applying a force.

Figure 2:
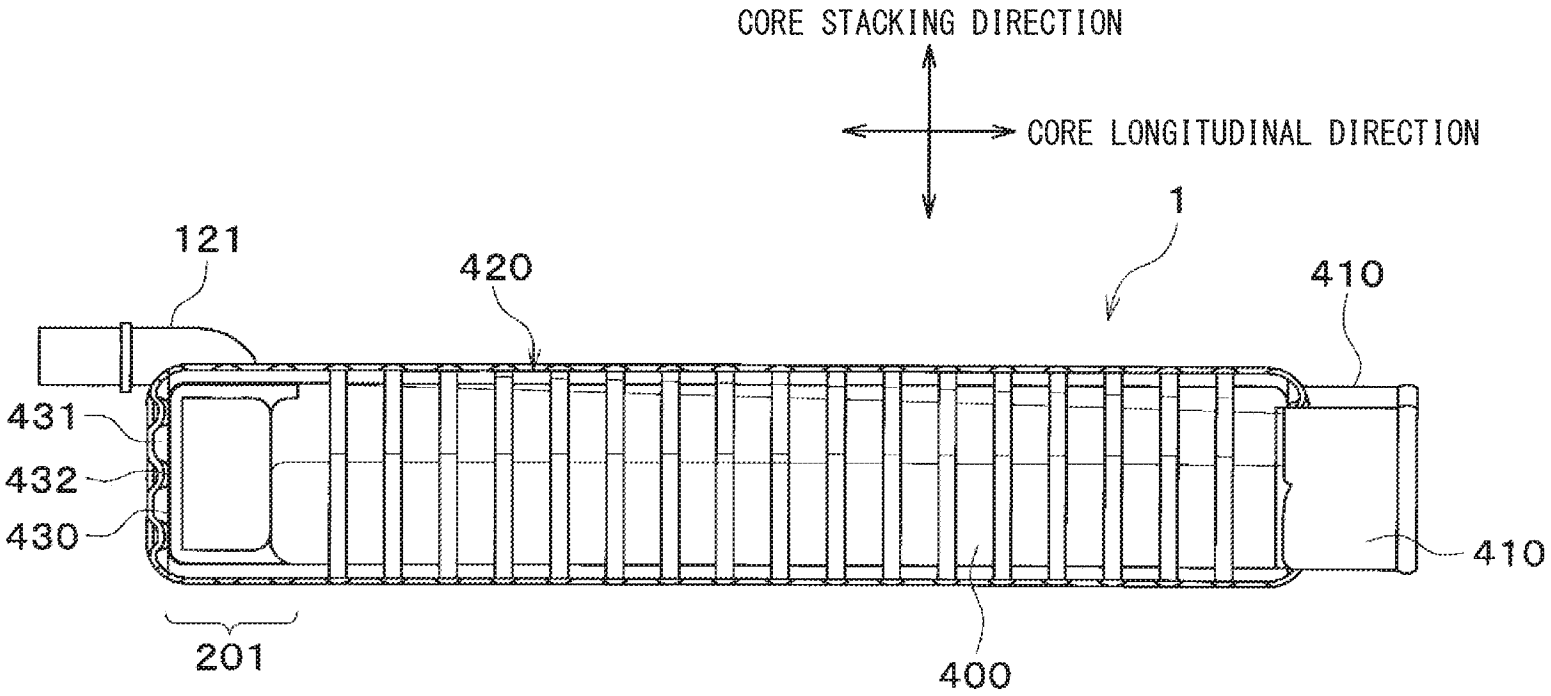
FIG. 2 is a view seen in an arrow direction II of FIG. 1.

The tank 400 is a piping through which the supercharged air flows. The tank 400 is disposed on an opposite side of the duct 100 and the core portion 200 through the caulking plate 300. As shown in FIGS. 1 and 2, the tank 400 has a supercharged-air side pipe 410, the opening portion 420, and an outer periphery 430.

The supercharged-air side pipe 410 serves as an inlet/outlet of the tank 400 for the supercharged air. The supercharged-air side pipe 410 is connected to a supercharger by piping (not shown). The opening portion 420 is inserted into the groove portion 310 of the caulking plate 300. A seal member 500 is inserted between the groove portion 310 of the caulking plate 300 and the opening portion 420 of the tank 400 (see FIG. 7).

The outer periphery 430 corresponds to the corrugated caulking part 330 of the caulking plate 300 in the opening portion 420. The entire outer periphery 430 is fixed by crimping by the corrugated caulking part 330. As shown in FIG. 2, the outer periphery 430 has a peak 431 and a valley 432 formed on the outer peripheral surface of the opening portion 420. The peaks 431 and the valleys 432 are arranged alternately in the circumferential direction of the opening portion 420.

The corrugated caulking part 330 covers the outer periphery 430 of the tank 400, and a part of the corrugated caulking part 330 corresponding to the valley 432 has a shape corresponding to the valley 432. In this way, the corrugated caulking part 330 fixes the entire outer periphery 430 in wave shapes by crimping.

The tank 400 is inserted into the caulking plate 300, such that the outer periphery 430 is covered by the corrugated caulking part 330. A part of the corrugated caulking part 330 corresponding to the valley 432 is pushed by a punch (not shown) toward the valley 432, such that the tank 400 is fixed to the caulking plate 300 by crimping. As a result, the part of the corrugated caulking part 330 corresponding to the valley 432 is deformed toward the valley 432.

Then, the corrugated caulking part corresponding to all of the valleys 432 are deformed by the punch. In this way, the tank 400 is fixed to the caulking plate 300 by crimping.

Next, the joint between the duct 100 and the caulking plate 300 will be described. The duct 100 and the caulking plate 300 are joined as follows.

First, the core portion 200 is prepared by alternately stacking the cooling plates 210 and the cooling fins 220. The core portion 200 is interposed between the two duct plates 110 and 120 and compressed to a predetermined size, and the caulking plate 300 is attached to the duct plate 110, 120. Then, the duct plate 110, 120 and the core portion 200 are joined by brazing, and the duct plate 110, 120 and the caulking plate 300 are joined by brazing.

FIG. 5 illustrates the inlet side of the duct 100 for the supercharged air. The outlet side has the same configuration as the inlet side. As shown in FIG. 5, the caulking plate 300 is attached to the end portion 110*a* of the first duct plate 110 and the end portion 120*a* of the second duct plate 120. The end portion 110*a*, 120*a* of the duct plate 110, 120 forms the inlet and the outlet of the duct 100. In this embodiment, the end portion 110*a* of the first duct plate 110 and the end portion 120*a* of the second duct plate 120 have different shapes.

The end portion 120*a* of the second duct plate 120 has an L-shaped cross section, and has a flange shape bent outward of the duct 100. The end portion 120*a* of the second duct plate 120 is joined to the bottom surface 310*a* of the groove portion 310 of the caulking plate 300. The joint surface between the second duct plate 120 and the caulking plate 300 is parallel to the core stacking direction.

The end portion 110*a* of the first duct plate 110 extends from the end of the core portion 200 in the supercharged air flow direction. Therefore, the end portion 110*a* of the first duct plate 110 is parallel to the supercharged air flow direction. The end portion 110*a* of the first duct plate 110 is joined to the inner wall surface 310*b* of the groove portion 310 of the caulking plate 300. The joint surface between the first duct plate 110 and the caulking plate 300 is parallel to the supercharged air flow direction.

A fillet portion 113 is formed at the end of the joint between the first duct plate 110 and the caulking plate 300 facing the core portion 200. The fillet portion 113 is formed so as to extend along the core longitudinal direction (perpendicular to the core stacking direction and the supercharged air flow direction in FIGS. 5 and 6) and to extend along the core stacking direction at both ends in the core longitudinal direction.

Figure 6:
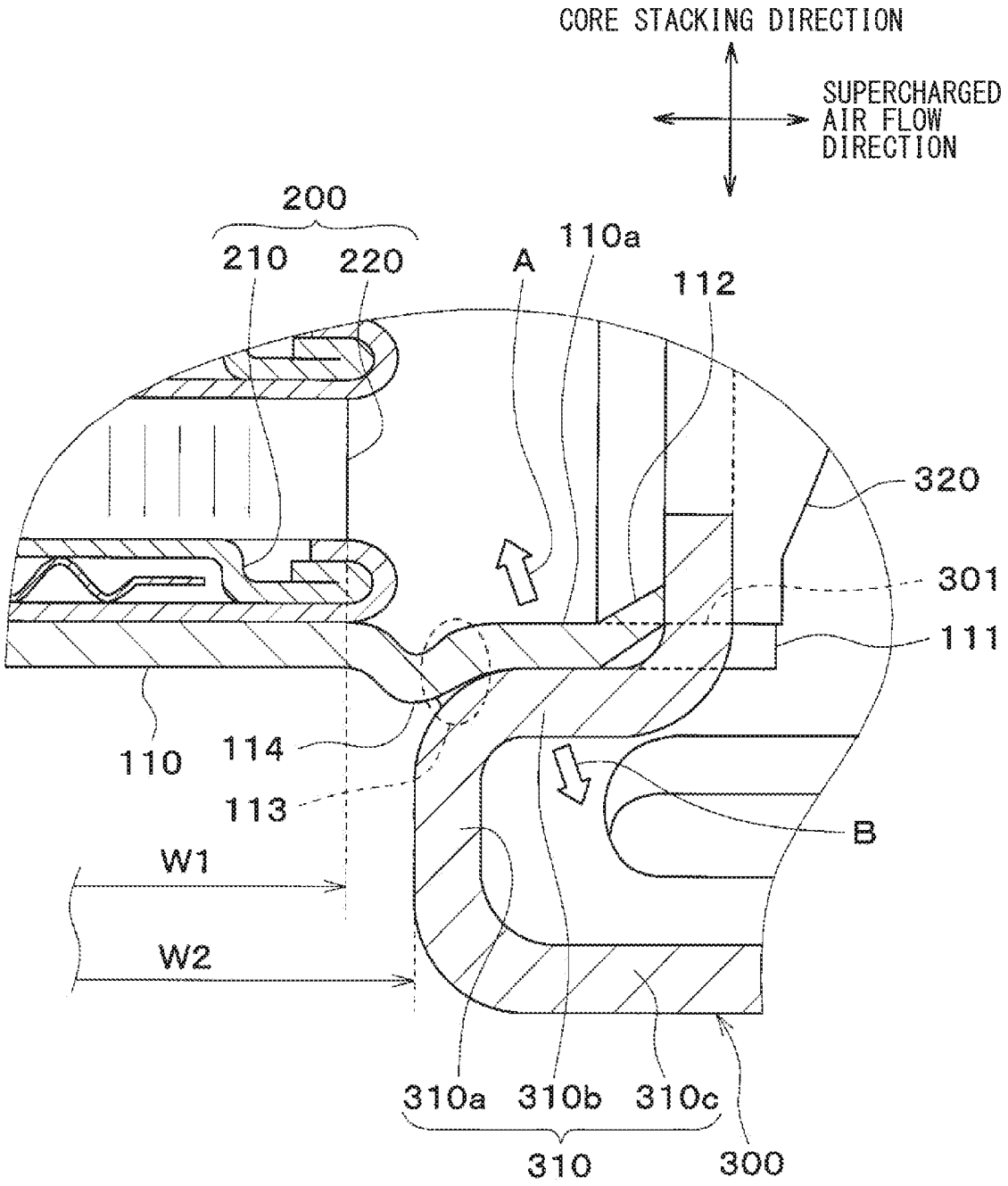
FIG. 6 is an enlarged cross-sectional view illustrating a joint between a first duct plate and a caulking plate.

As shown in FIGS. 5 and 6, the end portion 110*a* of the first duct plate 110 projects from the end of the core portion 200 in the supercharged air flow direction. A width W2 of the groove portion 310 of the caulking plate 300 in the supercharged air flow direction (hereinafter, referred to as "duct width W2") is longer than a width W1 of the core portion 200 in the supercharged air flow direction (hereinafter, referred to as "core width W1").

The joint between the first duct plate 110 and the caulking plate 300 is located outside the core portion 200 in the supercharged air flow direction. For this reason, a predetermined space is provided between the joint between the first duct plate 110 and the core portion 200 and the joint between the first duct plate 110 and the caulking plate 300. That is, the caulking plate 300 and the core portion 200 do not overlap each other when viewed in the core stacking direction.

As shown in FIG. 5, the end portion 110*a* of the first duct plate 110 has a fitting claw 111 and a stopper 112. The fitting claw 111 is longer than the stopper 112. The stopper 112 is inclined from the plate surface of the first duct plate 110 toward the inside of the duct 100.

The caulking plate 300 has a through hole 301 at a position corresponding to the fitting claw 111 of the first duct plate 110. When the caulking plate 300 is attached to the duct plate 110, 120, the fitting claw 111 of the first duct plate 110 is inserted into the through hole 301 of the caulking plate 300. At this time, the stopper 112 of the first duct plate 110 contacts the plate surface of the caulking plate 300. As a result, the caulking plate 300 is restricted from moving toward the core portion 200. That is, the caulking plate 300 is positioned by the stopper 112 of the first duct plate 110.

As shown in FIG. 6, a buffer rib 114 is formed on the first duct plate 110. The buffer rib 114 is provided on the surface of the first duct plate 110 that is orthogonal to the core stacking direction. The surface of the first duct plate 110 orthogonal to the core stacking direction is located on the lower side in FIGS. 5 and 6.

The buffer rib 114 is provided on the first duct plate 110 between a first joint and a second joint. The first joint is the joint between the first duct plate 110 and the core portion 200, and the second join is the joint between the first duct plate 110 and the caulking plate 300. That is, the buffer rib 114 is provided between the fillet portion 113 and the joint between the first duct plate 110 and the core portion 200, and is located closer to the core portion 200 than the fillet portion 113 is.

The buffer rib 114 is provided in parallel with the fillet portion 113, and is provided so as to extend in the core longitudinal direction (perpendicular to the core stacking direction and the supercharged air flow direction in FIGS. 5 and 6). The buffer rib 114 is provided so as to correspond to the entire fillet portion 113. The buffer rib 114 is formed as a groove having a substantially V-shaped cross section. The buffer rib 114 projects from the plane portion of the first duct plate 110 to the opposite side of the core portion 200 (away from the core portion 200). The buffer rib 114 can be formed by, for example, pressing.

The corner portion of the groove portion 310 of the caulking plate 300 is in contact with the protruding surface of the buffer rib 114 that projects from the plane portion of the first duct plate 110. As a result, the caulking plate 300 is restricted from moving toward the core portion 200, and the caulking plate 300 is positioned. The caulking plate 300 may be positioned with respect to the first duct plate 110 by a contact between the buffer rib 114 and the caulking plate 300.

The buffer rib 114 is more easily elastically deformed than the other parts of the first duct plate 110. Therefore, the buffer rib 114 provided on the first duct plate 110 functions as a damper that relieves stress. In the first duct plate 110, the buffer rib 114 is more easily elastically deformed than the fillet portion 113, such that the stress of the fillet portion 113 can be dispersed by the buffer rib 114. The buffer rib 114 serves as a deformation start point when the first duct plate 110 is deformed by the supercharged air passing through the inside of the duct 100.

The stress dispersion effect of the buffer rib 114 will be described. When the high-temperature and high-pressure supercharged air flows inside the duct 100, the duct 100 and the caulking plate 300 are deformed. At this time, as shown in FIG. 6, the deformation direction A of the first duct plate 110 is inward of the core stacking direction, and the deformation direction B of the caulking plate 300 is outward of the core stacking direction. In this way, since the deformation direction A of the first duct plate 110 and the deformation direction B of the caulking plate 300 are opposite from each other, a relative displacement occurs between the first duct plate 110 and the caulking plate 300, and stress is generated in the first duct plate 110.

Figure 7:
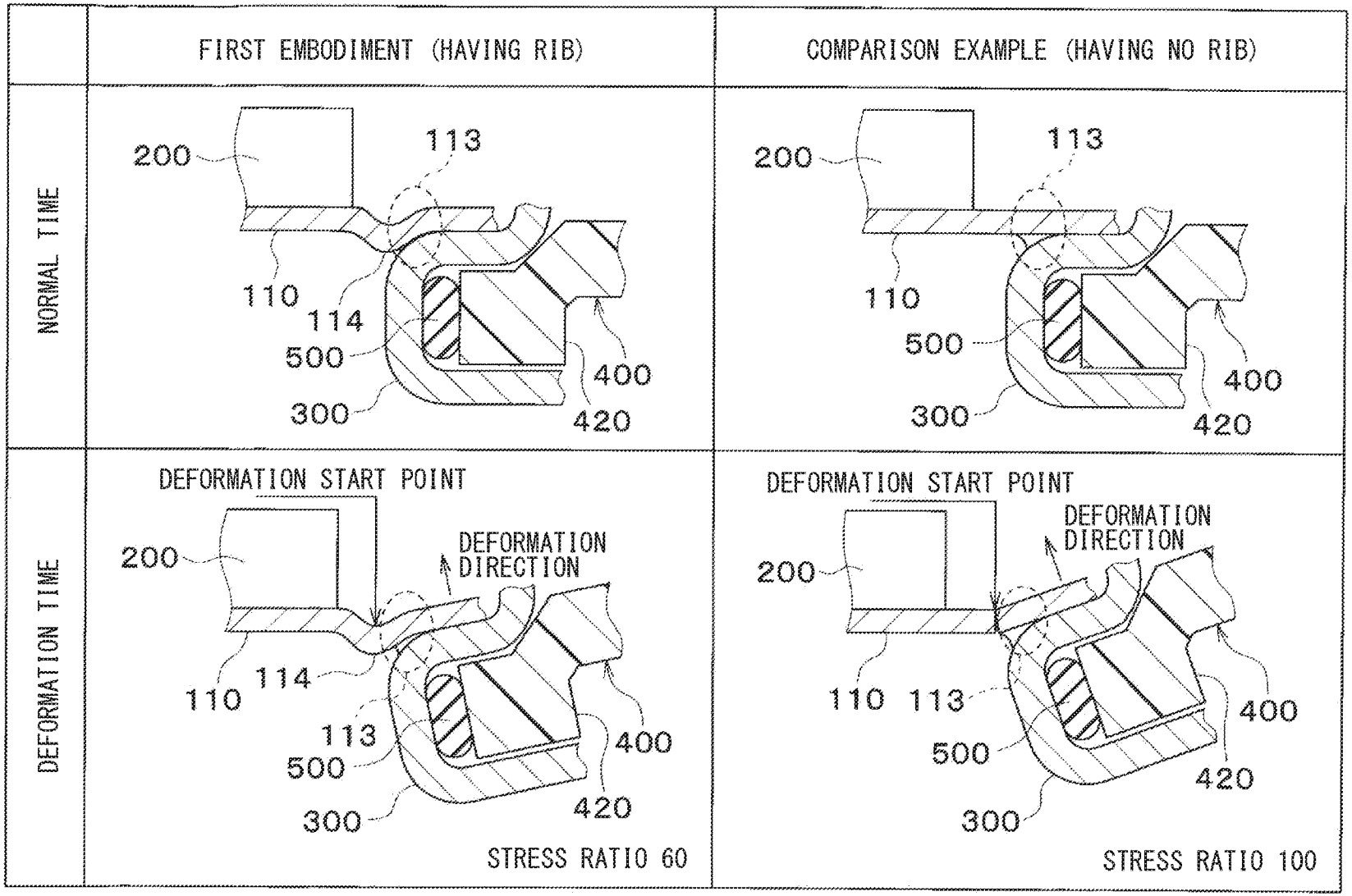
FIG. 7 is a diagram for explaining a stress dispersion effect by a rib of the first duct plate.

As shown in FIG. 7, in a comparison example, the buffer rib 114 is not provided on the first duct plate 110. When stress is generated in the first duct plate 110, the stress concentrates on the fillet portion 113 and the fillet portion 113 is a deformation start point. Therefore, the fillet portion 113 of the first duct plate 110 becomes a fragile portion, and the pressure withstanding property of the heat exchanger 1 decreases.

According to the present embodiment, the buffer rib 114 is provided. When the stress is generated in the first duct plate 110, the buffer rib 114 serves as a deformation start point, and the stress of the fillet portion 113 can be dispersed. As a result, the stress concentration on the fillet portion 113 can be relaxed, and the pressure withstanding property of the heat exchanger 1 can be improved.

In the comparison example in which the buffer rib 114 is not provided, when the stress ratio of the fillet portion 113 is 100, the stress ratio of the fillet portion 113 can be 60 in the present embodiment in which the buffer rib 114 is provided. As described above, in this embodiment, the stress of the fillet portion 113 can be relaxed by shifting the deformation start point from the fillet portion 113 to the buffer rib 114.

The buffer rib 114 of the first duct plate 110 is formed at a position where the stress dispersion effect is the highest. The stress dispersion effect is the highest when the buffer rib 114 is positioned between the first joint with the core portion 200 and the second joint with the caulking plate 300 in the first duct plate 110, in other words, when the buffer rib 114 is separated from the fillet portion 113 by a predetermined distance toward the core portion 200.

In the heat exchanger 1 of the present embodiment, the duct width W2 is longer than the core width W1. As a result, even when the stacking number of the cooling plates 210 and the cooling fins 220 of the core portion 200 is large, the caulking plate 300 can be easily attached to the duct plates 110, 120 between which the core portion 200 is arranged.

Further, in the present embodiment, the buffer rib 114 is provided on the first duct plate 110 between the first joint with the core portion 200 and the second joint with the caulking plate 300. Accordingly, when the duct 100 is deformed by the high-pressure supercharged air, the buffer rib 114 can be used as the deformation start point. As a result, the stress concentrated on the fillet portion 113 can be relaxed since the duct width W2 is longer than the core width W1, such that the pressure resistance of the heat exchanger 1 can be improved.

Further, in this embodiment, the caulking plate 300 is positioned by the stopper 112 and the buffer rib 114 provided on the first duct plate 110 with respect to the first duct plate 110. Accordingly, the position of the caulking plate 300 with respect to the first duct plate 110 can be accurately determined, and the buffer rib 114 can be provided at a position where the stress dispersion effect in the first duct plate 110 is the highest.

Second Embodiment

Next, a second embodiment of the present disclosure will be described. Hereinafter, only parts different from the first embodiment will be described.

Figure 8:
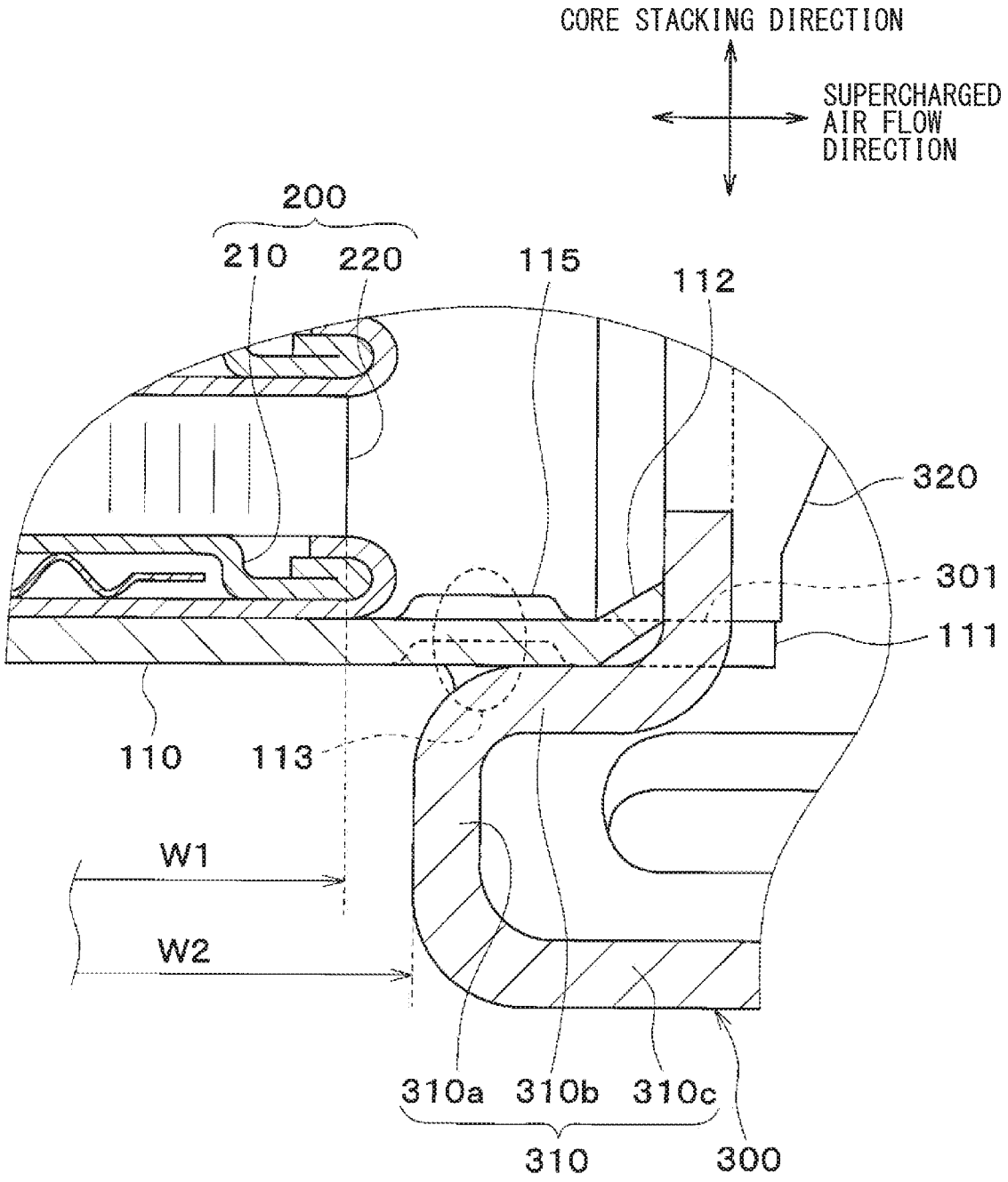
FIG. 8 is an enlarged cross-sectional view illustrating a joint between a first duct plate and a caulking plate according to a second embodiment.

As shown in FIG. 8, in the second embodiment, a reinforcing rib 115 is provided on the first duct plate 110. The reinforcing rib 115 is provided at the second joint between the first duct plate 110 and the caulking plate 300.

The reinforcing rib 115 is formed so as to punch out the plate surface of the first duct plate 110, and projects to the opposite side of the fillet portion 113. A part of the first duct plate 110 where the reinforcing rib 115 is provided has higher rigidity than the other portions and is less likely to be deformed. The reinforcing rib 115 can be formed by, for example, pressing.

The reinforcing rib 115 is provided on the first duct plate 110 so as to straddle over the fillet portion 113 in the supercharged air flow direction. That is, the reinforcing rib 115 is provided so as to cross the fillet portion 113 and is formed to extend along the core longitudinal direction (perpendicular to the core stacking direction and the supercharged air flow direction of FIG. 8). The reinforcing rib 115 intersects the fillet portion 113.

In the second embodiment, the reinforcing rib 115 is provided at plural positions. The reinforcing ribs 115 are arranged at predetermined intervals in the core longitudinal direction (perpendicular to the core stacking direction and the supercharged air flow direction of FIG. 8). The reinforcing rib 115 suppresses the deformation of the first duct plate 110 at the fillet portion 113.

In the second embodiment, the reinforcing rib 115 is provided on the first duct plate 110 so as to cross the fillet portion 113. Accordingly, when the duct 100 and the caulking plate 300 are deformed by the high-pressure supercharged air, it is possible to suppress the deformation at the fillet portion 113 that is a deformation start point of the first duct plate 110. As a result, it is possible to reinforce the fillet portion 113, which is a weak portion when the duct width W2 is made longer than the core width W1, so as to improve the pressure resistance of the heat exchanger 1.

The present disclosure is not limited to the embodiments described above, and various modifications can be made as follows within a scope not departing from the spirit of the present disclosure.

While the heat exchanger 1 is used as the water-cool intercooler in the above embodiments, the heat exchanger 1 may be used for other purposes.

In the first embodiment, the caulking plate 300 is positioned by the stopper 112 and the buffer rib 114, and the buffer rib 114 is provided at a position where the stress dispersion effect is maximized. The caulking plate 300 may be positioned by only one of the stopper 112 and the buffer rib 114.

In the first embodiment, the buffer rib 114 is provided so as to correspond to the entire fillet portion 113, but the buffer rib 114 may be provided so as to correspond to a part of the fillet portion 113. For example, when there is a deformable portion in the fillet portion 113, the buffer rib 114 may be provided corresponding to the deformable portion.

In the above embodiments, each of the buffer rib 114 and the reinforcing rib 115 is integrally provided with the first duct plate 110, but the buffer rib 114 and the reinforcing rib 115 may be provided separately from the first duct plate 110.

Although the present disclosure has been described in accordance with the examples, it is understood that the disclosure is not limited to such examples or structures. The present disclosure encompasses various modifications and variations within the scope of equivalents. In addition, while the various combinations and configurations, which are preferred, other combinations and configurations, including more, less or only a single element, are also within the spirit and scope of the present disclosure.

What is claimed is:

1. A heat exchanger comprising:

a duct having an inlet to introduce a first fluid and an outlet to discharge the first fluid;

a core portion having a plurality of cooling plates and a plurality of cooling fins alternately stacked with each other in a stacking direction and housed in the duct, in which heat is exchanged between the first fluid and a second fluid, a flow path being defined for the second fluid by the cooling plates; and a caulking plate having a frame shape corresponding to one of an opening shape of the inlet and the outlet and brazed to one of the inlet and the outlet, the caulking plate being interposed between the duct and a tank to fix the tank, wherein a first joint between the duct and the core portion and a second joint between the duct and the caulking plate are distanced from each other in a flow direction of the first fluid by a predetermined distance, the duct has a rib on a surface of the duct intersecting the stacking direction and the rib is located between the first joint and the second joint, and the rib extends in a longitudinal direction of the core portion intersecting the stacking direction and the flow direction of the first fluid.

2. The heat exchanger according to claim 1, wherein the rib is a buffer rib located between the first joint and the second joint to be a deformation start point when the duct is deformed.

3. The heat exchanger according to claim 1, wherein the rib is in contact with the caulking plate to fix a position of the caulking plate with respect to the duct.

4. The heat exchanger according to claim 1, wherein the duct has a stopper that comes into contact with a surface of the caulking plate facing the core portion, and the stopper is in contact with the caulking plate to fix a position of the caulking plate with respect to the duct.

5. The heat exchanger according to claim 1, wherein the rib protrudes away from the core portion in a cross section perpendicular to the longitudinal direction of the core portion.

6. The heat exchanger according to claim 1, wherein the flow direction of the first fluid is perpendicular to the longitudinal direction of the core portion and the stacking direction.

7. A heat exchanger comprising:

a duct having an inlet to introduce a first fluid and an outlet to discharge the first fluid;

a core portion having a plurality of cooling plates and a plurality of cooling fins alternately stacked with each other in a stacking direction and housed in the duct, in which heat is exchanged between the first fluid and a second fluid, a flow path being defined for the second fluid by the cooling plates; and a caulking plate corresponding to one of an opening shape of the inlet and the outlet and brazed to one of the inlet and the outlet, the caulking plate being interposed between the duct and a tank, wherein a first joint between the duct and the core portion and a second joint between the duct and the caulking plate are distanced from each other in a flow direction of the first fluid by a predetermined distance, the duct has a rib on a surface of the duct intersecting the stacking direction and the rib is located between the first joint and the second joint, the rib extends in a longitudinal direction of the core portion intersecting the stacking direction and the flow direction of the first fluid, and the flow direction of the first fluid is perpendicular to the longitudinal direction of the core portion and the stacking direction.

8. The heat exchanger according to claim 7, wherein the rib is a buffer rib located between the first joint and the second joint to be a deformation start point when the duct is deformed.

9. The heat exchanger according to claim 7, wherein the rib is in contact with the caulking plate to fix a position of the caulking plate with respect to the duct.

10. The heat exchanger according to claim 7, wherein the duct has a stopper that comes into contact with a surface of the caulking plate facing the core portion, and the stopper is in contact with the caulking plate to fix a position of the caulking plate with respect to the duct.

11. The heat exchanger according to claim 7, wherein the rib protrudes away from the core portion in a cross section perpendicular to the longitudinal direction of the core portion.

* * * * *